US008707622B1

(12) United States Patent
Neustel, Jr.

(10) Patent No.: US 8,707,622 B1
(45) Date of Patent: Apr. 29, 2014

(54) DOOR OPENING SYSTEM

(71) Applicant: Dennis R. Neustel, Jr., Robinson, ND (US)

(72) Inventor: Dennis R. Neustel, Jr., Robinson, ND (US)

( * ) Notice: Subject to any disclaimer, the term of this patent is extended or adjusted under 35 U.S.C. 154(b) by 0 days.

(21) Appl. No.: 13/680,256

(22) Filed: Nov. 19, 2012

(51) Int. Cl.
*E05F 13/00* (2006.01)

(52) U.S. Cl.
USPC ..... 49/263

(58) Field of Classification Search
USPC ..... 49/324, 339, 345, 346, 263
See application file for complete search history.

(56) References Cited

U.S. PATENT DOCUMENTS

| | | | | | |
|---|---|---|---|---|---|
| 447,090 | A | * | 2/1891 | Von Brandis et al. | 49/273 |
| 750,363 | A | * | 1/1904 | Hicks | 49/274 |
| 762,729 | A | * | 6/1904 | Lee | 49/263 |
| 839,330 | A | | 12/1906 | Stephenson | |
| 1,089,314 | A | * | 3/1914 | Brenner | 49/238 |
| 1,611,386 | A | * | 12/1926 | Stanley | 49/263 |
| 1,676,164 | A | * | 7/1928 | Schlaegel | 49/263 |
| 2,634,970 | A | * | 4/1953 | Rosebrook | 49/344 |
| 2,809,030 | A | * | 10/1957 | Clark | 49/274 |
| 3,364,621 | A | * | 1/1968 | Erickson | 49/263 |
| 4,569,546 | A | | 2/1986 | Howard | |
| 4,621,848 | A | | 11/1986 | Pierce | |
| 5,193,863 | A | * | 3/1993 | McBain | 292/255 |
| 5,622,416 | A | * | 4/1997 | Rainey et al. | 312/319.9 |
| 6,360,488 | B1 | * | 3/2002 | Darling | 49/274 |
| 7,270,352 | B1 | | 9/2007 | Stuart | |

* cited by examiner

*Primary Examiner* — Katherine Mitchell
*Assistant Examiner* — Scott Denion
(74) *Attorney, Agent, or Firm* — Michael S. Neustel

(57) ABSTRACT

A door opening system for assisting an individual to open a door without having to touch a handle. The door opening system generally includes a connecting member rotatably attached to a wall adjacent a door, a foot pedal attached to a lower end of the connecting member, and a lever attached to an upper end of the connecting member. An engaging member is attached to an upper end of the door to be opened and is engaged by the lever when a user pushes upon the foot pedal causing rotation of the connecting member and the lever. The lever forces the door open so the user does not have to engage handle of the door.

19 Claims, 6 Drawing Sheets

DOOR OPENING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a door opening device and more specifically it relates to a door opening system for assisting an individual to open a door without having to touch a handle.

2. Description of the Related Art

Any discussion of the related art throughout the specification should in no way be considered as an admission that such related art is widely known or forms part of common general knowledge in the field.

Conventional doors include a handle that a user grasps with their hands to open the door. The problem with conventional doors is that the handles become contaminated by prior users of the door (e.g. dirt, bacteria, germs). Restroom doors in public facilities (e.g. gas stations, bars, truck stops, lounges, restaurants) are highly susceptible to contamination by users of the restroom resulting in subsequent users' hands to become contaminated by touching the handle of the door. This is particularly problematic for individuals who have washed their hands prior to leaving the restroom and are forced to physically engage the handle of the door. To avoid contamination in public restrooms, some people use a paper towel to engage the handle resulting in paper towels being deposited on the floor in the restroom after usage and increased waste material.

Because of the inherent problems with the related art, there is a need for a new and improved door opening system for assisting an individual to open a door without having to touch a handle.

BRIEF SUMMARY OF THE INVENTION

The invention generally relates to a door opening devices which includes a connecting member rotatably attached to a wall adjacent a door, a foot pedal attached to a lower end of the connecting member, and a lever attached to an upper end of the connecting member. An engaging member is attached to an upper end of the door to be opened and is engaged by the lever when a user pushes upon the foot pedal causing rotation of the connecting member and the lever. The lever forces the door open so the user does not have to engage handle of the door.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
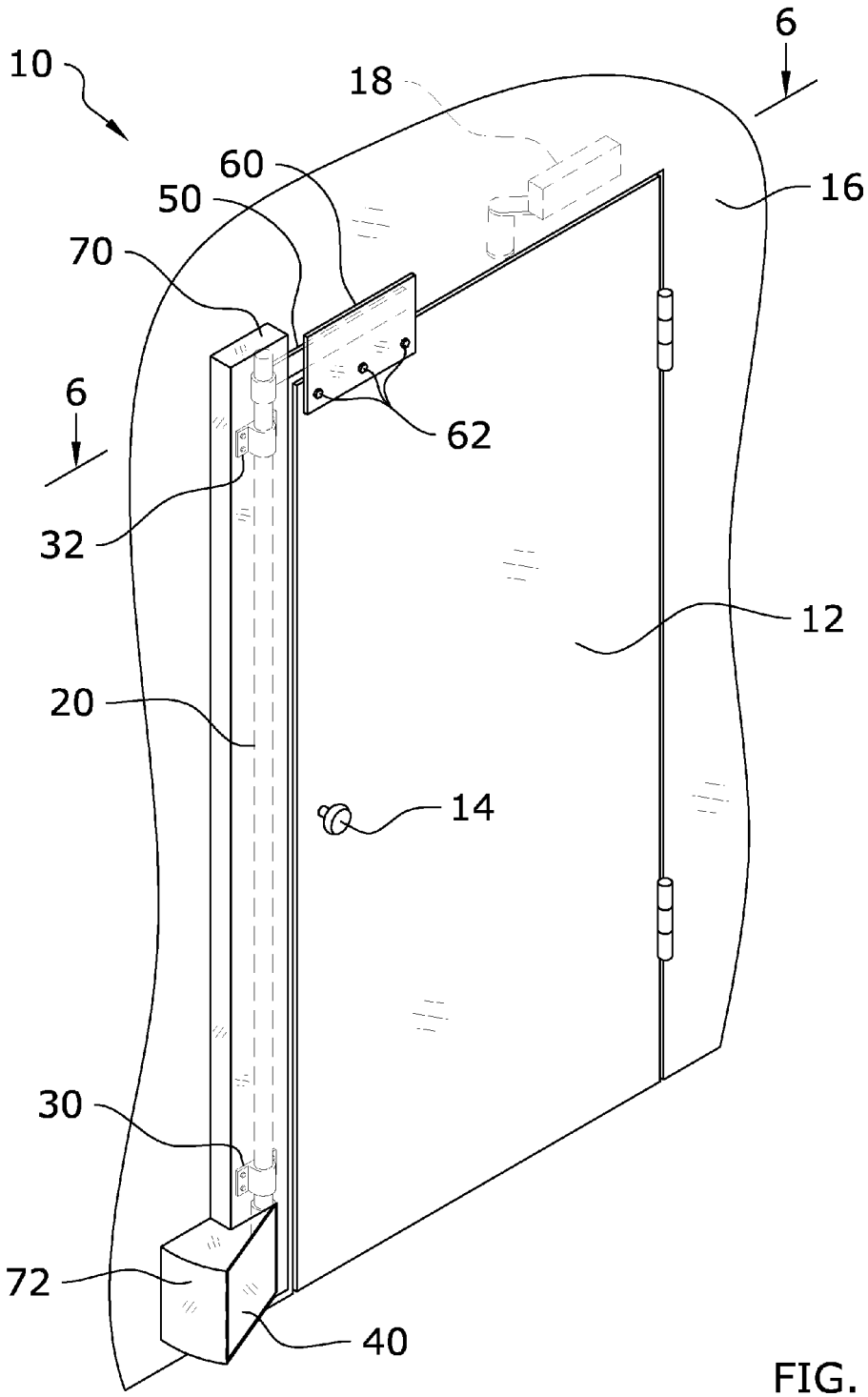
FIG. 1 is an upper perspective view of the present invention.

Turning now descriptively to the drawings, in which similar reference characters denote similar elements throughout the several views, FIGS. 1 through 6*b* illustrate a door opening system 10, which comprises a connecting member 20 rotatably attached to a wall 16 adjacent a door 12, a foot pedal 40 attached to a lower end of the connecting member 20, and a lever 50 attached to an upper end of the connecting member 20. An engaging member 60 is attached to an upper end of the door 12 to be opened and is engaged by the lever 50 when a user pushes upon the foot pedal 40 causing rotation of the connecting member 20 and the lever 50. The lever 50 forces the door 12 open so the user does not have to engage handle 14 of the door 12. The present invention may be attached to an existing door 12 or installed with a new door 12.

B. Door

Figure 2:
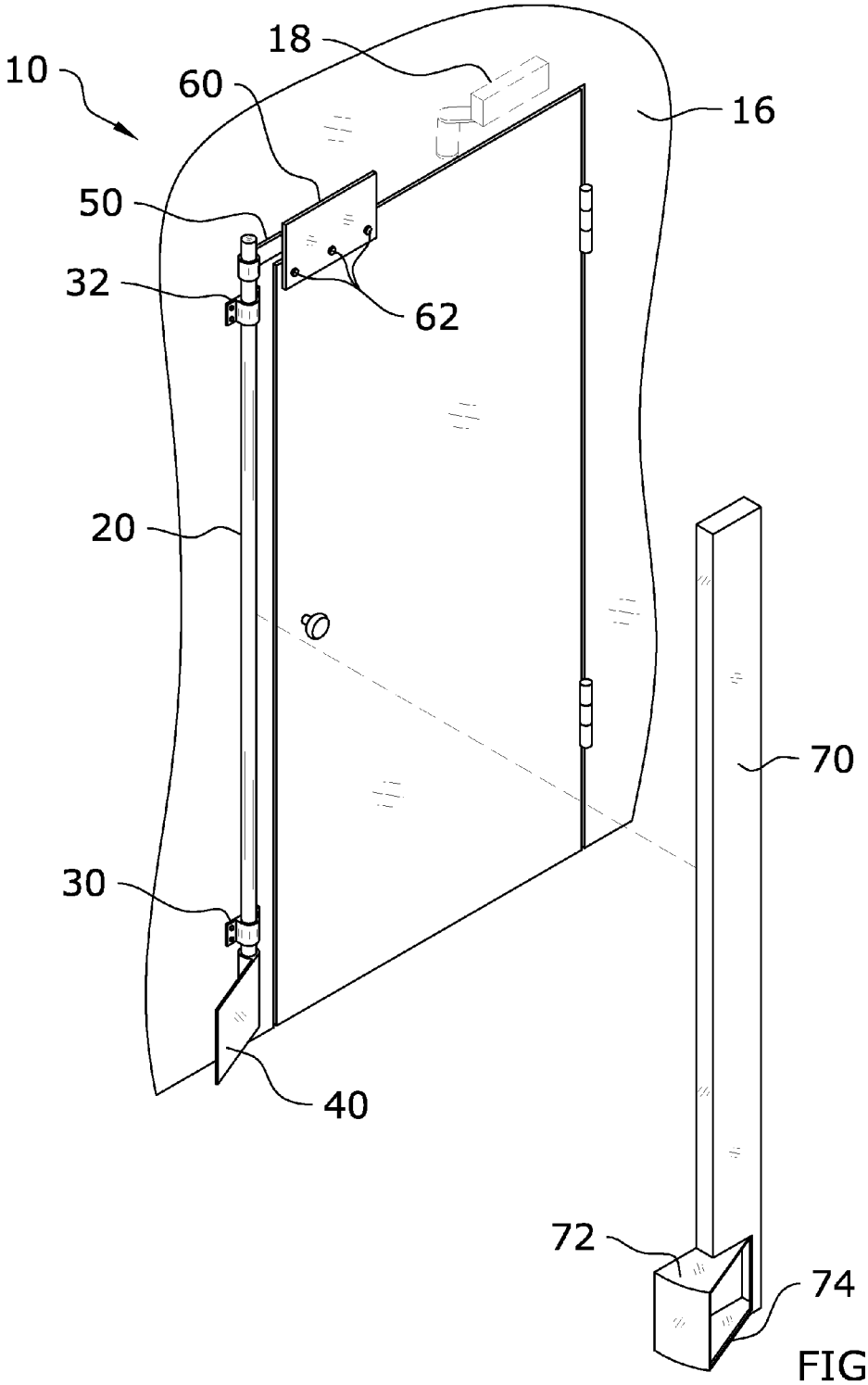
FIG. 2 is an upper perspective view of the present invention with the cover member removed.
Figure 3:
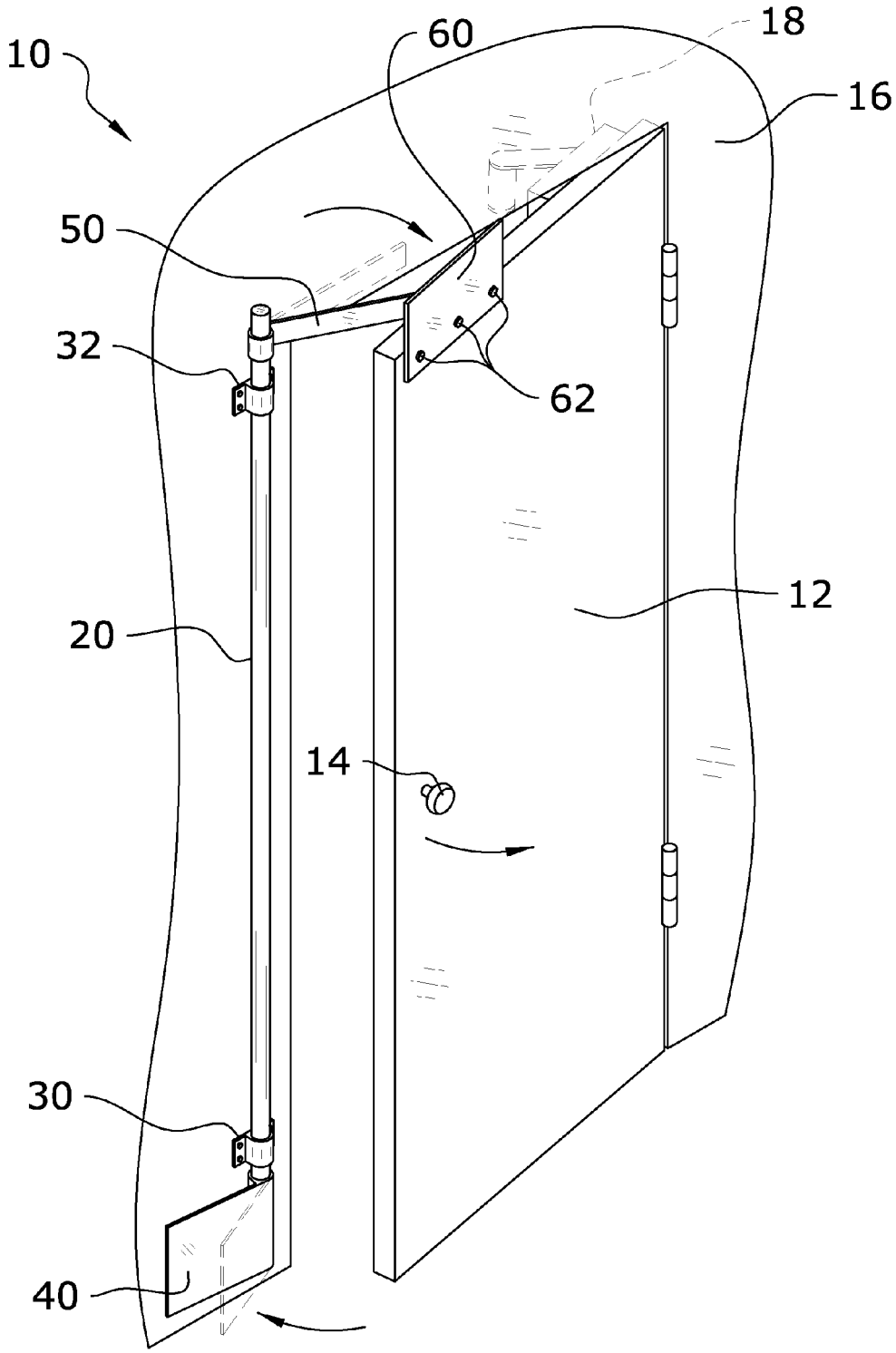
FIG. 3 is an upper perspective view of the present invention opening a door.
Figure 5:
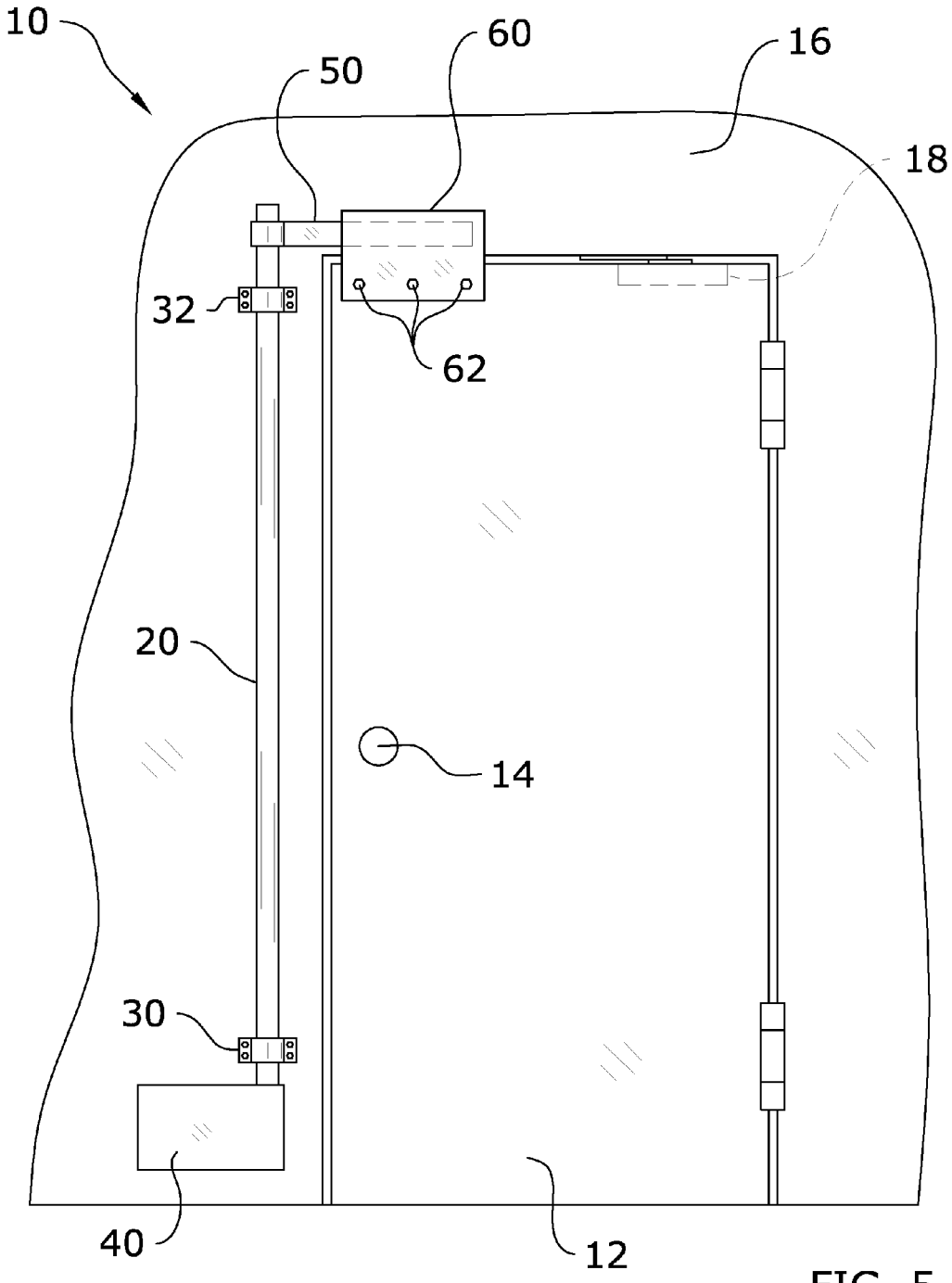
FIG. 5 is a front view of the present invention.
Figure 6A:
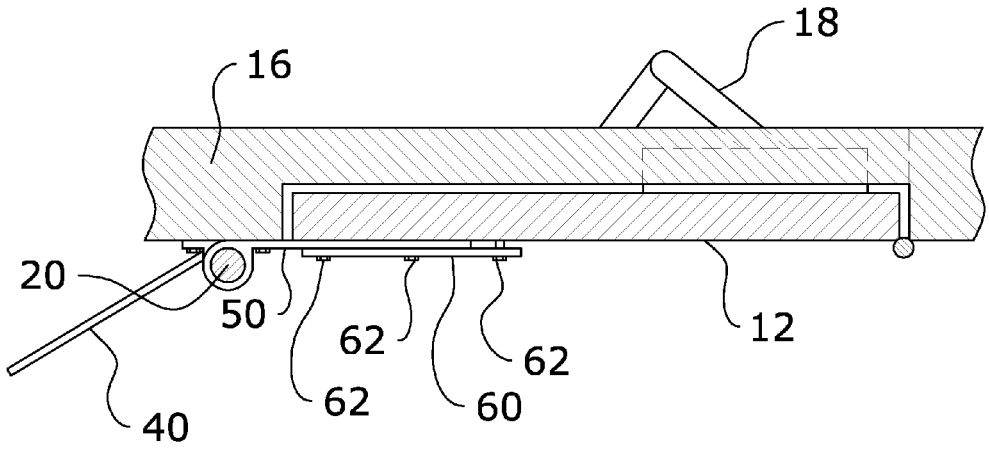
FIG. 6*a* is a cross sectional view taken along line 6-6 of FIG. 1 with the door closed.
Figure 6B:
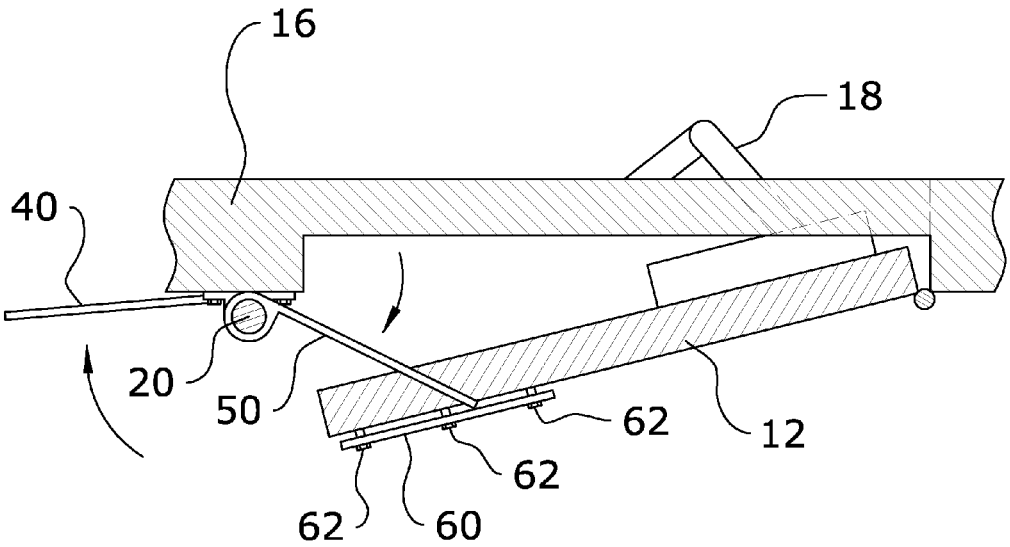
FIG. 6*b* is a cross sectional view taken along line 6-6 of FIG. 1 with the door opened.

FIGS. 1, 2, 3, 5, 6*a* and 6*b* of the drawings illustrate an exemplary door 12 pivotally attached to wall 16 with hinges. The door 12 is positioned within an opening within the wall 16, typically surrounded by a frame. The door 12 may be closed as illustrated in FIGS. 1, 2 and 6*a* of the drawings, or the door 12 may be pivoted open as illustrated in FIGS. 3, 6*b* of the drawings.

The door 12 is typically comprised of a vertically orientated planar panel structure as is well known with conventional doors 12. The door 12 may be comprised of a structure that forms a selective entrance to a restroom or other structure. The door 12 preferably opens inwardly into the room (e.g. restroom) as illustrated in FIG. 3 of the drawings.

The door 12 may include a handle 14 such as a rotatable knob or U-shaped handle 14 attached to the interior of the door 12 to allow for a user to open the door 12 from the inside of the room. FIGS. 1 through 3 illustrate an exemplary handle 14 comprised of a knob structure, but it can be appreciated that the handle 14 may be comprised of various other structures. It can also be appreciated that the door 12 does not require a handle 14 to be attached when using the present invention.

It is preferable that the door 12 include a closing device 18 that biases the door 12 into the closes position. The closing device 18 may be spring or hydraulic biased. The closing device 18 includes an arm that connects the closing device 18 and the door 12 wherein the closing device 18 is attached to the outside surface of the door 12. The closing device 18 may be comprised of any conventional device utilized to apply a closing force to a door 12 (e.g. a hydraulic door 12 closer).

C. Connecting Member

Figure 4:
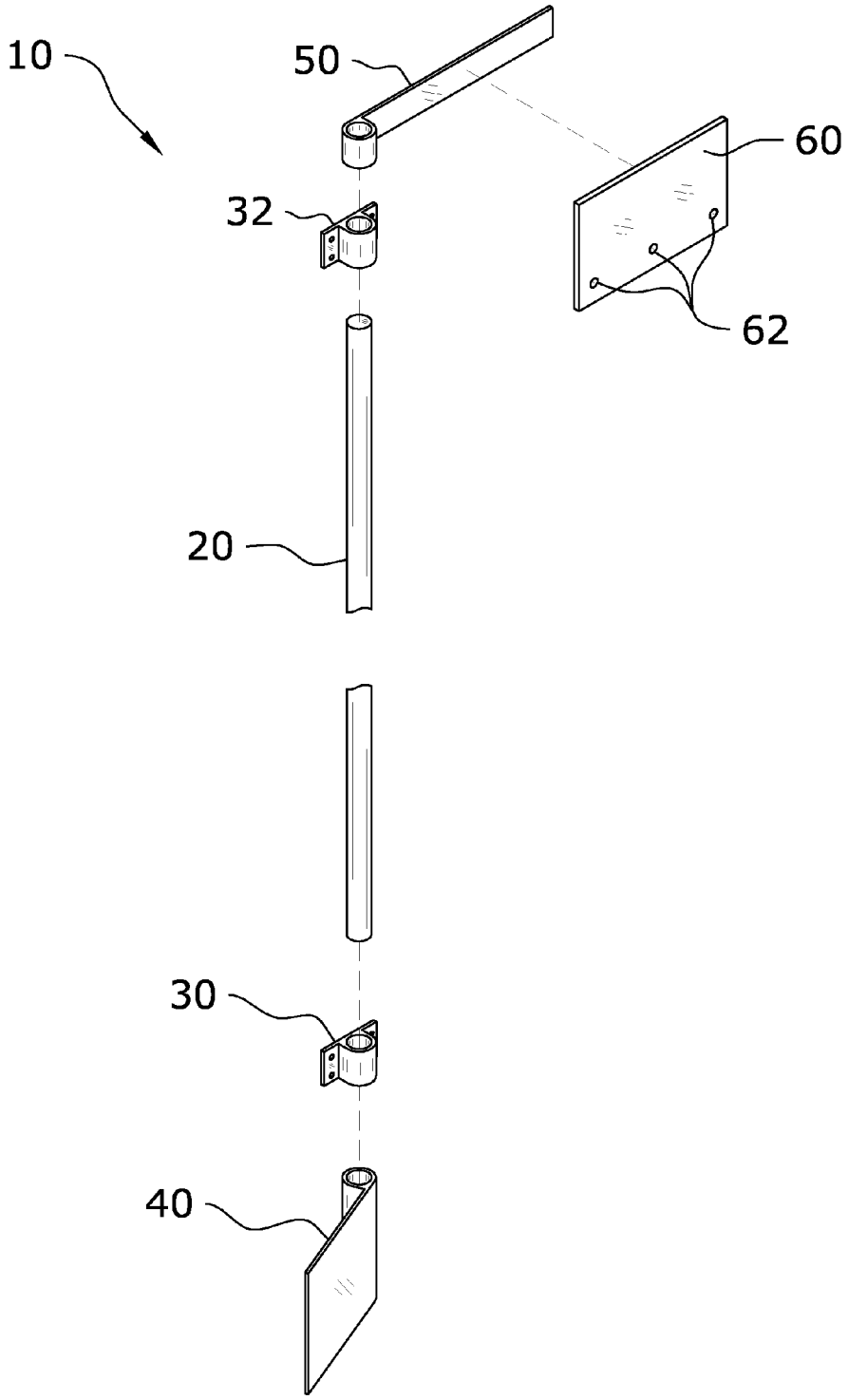
FIG. 4 is an exploded upper perspective view of the present invention.

FIGS. 2 through 5 best illustrate the connecting member 20 that is rotatably attached to the inside surface of the wall 16 adjacent to an outer edge of a door 12. The connecting member 20 may be positioned within the interior of the wall 16 to hide the connecting member 20 and related components. The connecting member 20 is comprised of an elongated member (e.g. elongated shaft, elongated tube) that is vertically orientated. The connecting member 20 has a length sufficient to extend from the lower portion of the door 12 to above the upper edge of the door 12 as illustrated in FIG. 5 of the drawings. The connecting member 20 is parallel to the outer edge of the door 12 as best illustrated in FIG. 5 of the drawings.

D. Brackets

FIGS. 2 through 5 illustrate a lower bracket 30 and an upper bracket 32 attached to the wall 16. The lower bracket 30 and the upper bracket 32 rotatably receive the connecting member 20 as illustrated in FIGS. 2, 3 and 5 of the drawings. The lower bracket 30 is positioned upon a lower portion of the connecting member 20 and the upper bracket 32 is positioned upon an upper portion of the connecting member 20 as illustrated in FIG. 5 of the drawings. It can be appreciated that additional brackets may be utilized to rotatably support the connecting member 20. The connecting member 20 rotates upon a vertical axis that is parallel to the outer edge of the door 12.

E. Foot Pedal

FIGS. 1 through 6*b* illustrate an exemplary foot pedal 40 that a user engages with their foot to open the door 12. The foot pedal 40 is attached to a lower end of the connecting member 20 as illustrated in FIGS. 2, 3 and 5 of the drawings. The foot pedal 40 is comprised of a plate member as best illustrated in FIG. 4 of the drawings, however, various other configurations for the foot pedal 40 may be utilized. The foot pedal 40 has a front surface sufficient in size and shape to receive a foot of the user without the user having to expend a significant amount of effort engaging the foot pedal 40. The foot pedal 40 is positioned slightly above the ground surface within the room as best illustrated in FIGS. 2, 3 and 5 of the drawings.

F. Lever

FIGS. 2 through 6*b* of the drawings illustrate an exemplary lever 50 attached to an upper end of the connecting member 20 opposite of the foot pedal 40. The lever 50 extends transversely with respect to the connecting member 20 towards the door 12 as illustrated in FIGS. 2 and 3 of the drawings. The lever 50 preferably is comprised of an elongated structure having a length approximately less than half of the width of the door 12 as illustrated in FIGS. 3 and 5 of the drawings, however, various other lengths may be utilized for the lever 50. The lever 50 preferably is comprised of a rigid thin member having a narrow distal end that slidably engages the engaging member 60 to force the engaging member 60 along with the door 12 open when the foot pedal 40 is engaged.

G. Engaging Member

The engaging member 60 is attached to the upper portion of the door 12 as illustrated in FIGS. 1, 2, 3 and 5 of the drawings. The engaging member 60 preferably extends above the upper edge of the door 12 as best illustrated in FIG. 5 of the drawings. The foot pedal 40 and the engaging member 60 are preferably not parallel to one another and are instead offset from one another so that the lever 50 is parallel to the door 12 when the door 12 is closed as illustrated in FIG. 6*a* of the drawings and wherein the foot pedal 40 is parallel to the wall 16 when the door 12 is opened as illustrated in FIG. 6*b* of the drawings.

The engaging member 60 is comprised of a plate member that has a relatively broad structure and sufficient in width to allow the lever 50 to engage and slide upon during opening of the door 12 as illustrated in FIGS. 2, 3, 5, 6*a* and 6*b* of the drawings. The engaging member 60 is adapted to be engaged by the lever 50 for selectively opening the door 12 so that when a user pushes the foot pedal 40 with a foot the lever 50 engages the engaging member 60 thereby opening the door 12 as illustrated in FIGS. 3 and 6*b* of the drawings.

The engaging member 60 is attached to the door 12 by a plurality of conventional fasteners 62 (e.g. screws, bolts). The engaging member 60 preferably is distally spaced from the inside surface of the door 12 as best illustrated in FIGS. 6*a* and 6*b* of the drawings. Spacers or similar structures may be positioned between a lower portion of the engaging member 60 and the inside surface of the door 12 to space the same apart with the fasteners 62 extending through the lower portion of the engaging member 60 as illustrated in FIG. 5 of the drawings. The spacing between the engaging member 60 and the inside surface of the door 12 provides sufficient space for the lever 50 to extend between the wall 16 and the interior surface of the engaging member 60 when the door 12 is in the closed position as illustrated in FIG. 6*a* of the drawings.

H. Cover Member

FIGS. 1 and 2 illustrate a cover member 70 adapted to cover the connecting member 20 and the brackets 30, 32 from view by users. The cover member 70 preferably includes a lower cover 72 that extends inwardly and outwardly with a lower opening 74 as illustrated in FIGS. 1 and 2 of the drawings. The lower cover 72 is positioned over the foot pedal 40, wherein the lower opening 74 provides access to the foot pedal 40 by the user's foot. The cover member 70 may be attached about the connecting member 20 by attaching to the wall 16 or the brackets 30, 32.

I. Operation of Preferred Embodiment

Initially when the door 12 is in the closed position (FIGS. 1, 2 and 6*a*), the lever 50 is substantially parallel to the door 12 and the engaging member 60 as illustrated in FIGS. 1, 2 and 6*a* of the drawings. When the door 12 is in the closed position, the foot pedal 40 extends inwardly into the room at an angle as illustrated in FIGS. 2 and 6*a* of the drawings.

When the user desires to leave the room, instead of grasping the handle 14 of the door 12, the user presses upon the foot pedal 40 forcing the foot pedal 40 towards the wall 16 with their foot which causes the connecting member 20 and the lever 50 to correspondingly rotate. Since the lever 50 extends in a direction from the connecting member 20 opposite of the foot pedal 40, the lever 50 pivots away from the wall 16 thereby engaging the engaging member 60 resulting in the door 12 to be opened as illustrated in FIGS. 3 and 6*b* of the drawings. With the door 12 partially opened as illustrated in FIG. 3, the user then extends their arm between the door 12 and the wall 16 thereby allowing the user to completely open the door 12 with their arm (without touching the door 12 with their hands). The door 12 is then either allowed to remain open or is closed automatically via the closing device 18.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above.

All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A door opening system for opening a door, comprising:

a connecting member adapted to be rotatably attached to a wall adjacent a door, said door being adapted to rotate about a first axis when installed in said wall, wherein said connecting member extends from a lower portion of said door to above an upper edge of said door;

a foot pedal attached to a lower end of said connecting member, said foot pedal and said connecting member being rotatable about a second axis substantially parallel to said first axis when attached to said wall;

a lever attached to an upper end of said connecting member; and an engaging member adapted to be attached to the door and is adapted to be engaged by said lever when a user pushes said foot pedal with a foot causing rotation of said connecting member and said lever thereby opening the door.

2. The door opening system of claim 1, wherein said connecting member is vertically orientated.

3. The door opening system of claim 1, wherein said connecting member is comprised of an elongated member.

4. The door opening system of claim 1, including a lower bracket and an upper bracket, wherein said brackets rotatably receive said connecting member.

5. The door opening system of claim 1, wherein said engaging member is comprised of a plate member.

6. The door opening system of claim 1, wherein said foot pedal is comprised of a plate member.

7. The door opening system of claim 1, wherein said foot pedal and said engaging member are not parallel to one another.

8. The door opening system of claim 1, wherein said lever extends transversely with respect to said connecting member.

9. The door opening system of claim 1, including a cover member adapted to cover said connecting member.

10. The door opening system of claim 9, wherein said cover member includes a lower cover with a lower opening, wherein said lower cover is positioned over said foot pedal and wherein said lower opening provides access to said foot pedal by the user's foot.

11. A door opening system for opening a door, comprising:

a connecting member rotatably attached to a wall adjacent a door, said door being adapted to rotate about a first axis when installed in said wall;

a foot pedal attached to a lower end of said connecting member, said foot pedal and said connecting member being rotatable about a second axis substantially parallel to said first axis when attached to said wall, wherein said lower end of said connecting member is positioned adjacent to a lower end of said door;

a lever attached to an upper end of said connecting member, wherein said upper end of said connecting member is positioned above an upper edge of said door;

a cover member adapted to cover an entire length of said connecting member; and an engaging member attached to said door, wherein said engaging member is adapted to be engaged by said lever for selectively opening said door, wherein when a user pushes said foot pedal with a foot said lever engages said engaging member thereby opening said door.

12. The door opening system of claim 11, wherein said connecting member is vertically orientated.

13. The door opening system of claim 11, wherein said connecting member is comprised of an elongated member.

14. The door opening system of claim 11, including a lower bracket and an upper bracket attached to said wall, wherein said brackets rotatably receive said connecting member.

15. The door opening system of claim 11, wherein said engaging member is comprised of a first plate member and wherein said foot pedal is comprised of a second plate member.

16. The door opening system of claim 15, wherein said foot pedal and said engaging member are not parallel to one another.

17. The door opening system of claim 11, wherein said lever extends transversely with respect to said connecting member.

18. The door opening system of claim 11, wherein said cover member includes a lower cover with a lower opening, wherein said lower cover is positioned over said foot pedal and wherein said lower opening provides access to said foot pedal by the user's foot.

19. A door opening system, comprising:

a door positioned within an opening within a wall, said door being adapted to rotate about a first axis when installed in said wall, wherein said door is surrounded by a frame;

a connecting member rotatably attached to a wall adjacent to an outer edge of said door, wherein said connecting member is comprised of an elongated member, wherein said connecting member is vertically orientated and wherein said connecting member is parallel to said outer edge;

a lower bracket and an upper bracket attached to said wall, wherein said brackets rotatably receive said connecting member;

a foot pedal attached to a lower end of said connecting member, said foot pedal and said connecting member being rotatable about a second axis substantially parallel to said first axis when attached to said wall, wherein said foot pedal is comprised of a second plate member, wherein said lower end of said connecting member is positioned adjacent to a lower end of said door;

a lever attached to an upper end of said connecting member, wherein said lever extends transversely with respect to said connecting member, wherein said upper end of said connecting member and said lever are positioned above an upper edge of said door;

an engaging member attached to said door, wherein said engaging member is comprised of a first plate member, wherein said engaging member is adapted to be engaged by said lever for selectively opening said door, wherein when a user pushes said foot pedal with a foot said lever engages said engaging member thereby opening said door;

wherein said foot pedal and said engaging member are not parallel to one another;

a cover member adapted to cover said connecting member, wherein said cover member includes a lower cover with a lower opening, wherein said lower cover is positioned over said foot pedal and wherein said lower opening provides access to said foot pedal by the user's foot.

* * * * *